US007629757B2

(12) United States Patent
Murphy et al.

(10) Patent No.: US 7,629,757 B2
(45) Date of Patent: Dec. 8, 2009

(54) POWERED COSMETIC DISPENSER

(75) Inventors: Peter D. Murphy, Cockeysville, MD (US); LeMoyne Boyer, Sugar Land, TX (US); Tomas Charles Doupnik, Austin, TX (US); Donald James Sanda, Rosenberg, TX (US)

(73) Assignee: The Electric Lipstick Company, LLC, Dover, DE (US)

( * ) Notice: Subject to any disclaimer, the term of this patent is extended or adjusted under 35 U.S.C. 154(b) by 437 days.

(21) Appl. No.: 11/687,955

(22) Filed: Mar. 19, 2007

(65) Prior Publication Data

US 2008/0230086 A1 Sep. 25, 2008

(51) Int. Cl.
*A45D 40/06* (2006.01)

(52) U.S. Cl. ..... 318/266; 401/55; 318/286; 318/466

(58) Field of Classification Search ..... 318/264–266, 318/272, 286, 466–468, 558; 132/320; 401/55, 401/59–62, 64
See application file for complete search history.

(56) References Cited

U.S. PATENT DOCUMENTS

| | | | | |
|---|---|---|---|---|
| 3,246,657 | A | | 4/1966 | Roller, Sr. |
| 3,612,072 | A | | 10/1971 | Fukui |
| 3,850,183 | A | | 11/1974 | Gruska |
| 4,165,513 | A | | 8/1979 | Flory |
| 4,888,667 | A | | 12/1989 | Hwang |
| 4,905,128 | A | | 2/1990 | Caires |
| 5,171,096 | A | * | 12/1992 | Perrotti ..... 401/59 |
| 5,174,440 | A | | 12/1992 | Chiu |
| 5,238,319 | A | | 8/1993 | Lucas |
| 5,423,622 | A | | 6/1995 | Perrotti |
| 5,890,826 | A | | 4/1999 | Kim |
| 5,904,431 | A | | 5/1999 | Terruzzi |
| 5,979,468 | A | | 11/1999 | Blake, III |
| 6,102,598 | A | | 8/2000 | Hsu |
| 6,565,276 | B1 | | 5/2003 | Diaz |
| 6,588,959 | B1 | | 7/2003 | Kuo |
| 2004/0158350 | A1 | | 8/2004 | Ostergaard et al. |
| 2004/0213624 | A1 | | 10/2004 | Petit |
| 2006/0029456 | A1 | | 2/2006 | Liu |
| 2006/0249530 | A1 | | 11/2006 | Ho |

* cited by examiner

*Primary Examiner*—Bentsu Ro
(74) *Attorney, Agent, or Firm*—Womble Carlyle Sandridge & Rice, PLLC; Lewis S. Rowell

(57) ABSTRACT

A powered dispenser is provided for cosmetic sticks. The dispenser includes a case and a cosmetic cup that is disposed within the case and that is dimensioned for holding a cosmetic stick. A powered control mechanism is provided for moving the cup upwardly and downwardly within the case so that a cosmetic stick, such as lipstick, is selectively movable between an extended position wherein it can be applied by the user and a retracted, storage position within the case.

11 Claims, 7 Drawing Sheets

POWERED COSMETIC DISPENSER

FIELD OF THE INVENTION

The present invention relates generally to the field of cosmetics and the application or dispensing thereof, and more particularly, to a powered dispenser for stick-type cosmetics.

BACKGROUND OF THE INVENTION

Rotary lipstick dispensers have been around for many decades. This popular, functional, and often, indispensable cosmetic device has been the subject of countless improvements primarily to enhance its aesthetics, functionality, and cost. With respect to functionality, most of the improvements in the art have been directed to the intricate mechanical assembly and operation of the dispenser. Nonetheless, as shown in FIG. 1, the rotary lipstick dispenser 100 of the prior art still comprises a base 120 having one or more inner rotary tubes 130, a lipstick 140 or other cosmetic stick device affixed within a holder in the innermost rotary tube 130, and an outer tubular cap 160.

With most prior art devices, a user must first remove the tubular cap 160 before manually extending the lipstick outwardly from the tubular base 120. Removal and replacement of the tubular cover 160 quite often leads to damage and/or deformation of the soft lipstick itself, especially when the user attempts to use the dispenser in dimly lighted areas. If damaged, the user must often discard the dispenser with any remaining lipstick and purchase a new dispenser.

In more recent years, attempts have been made to eliminate the removable cover 160 and to replace it with a retractable lip or other movable protective cap. The various designs have incorporated spherical caps and flat, flexible membranes; however, these designs have only created awkwardly shaped, bulky containers which still require two hands to operate the mechanism manually.

What is first needed is a cosmetic dispenser that retains an ergonomically-appealing shape, that addresses the problems with removable and retractable caps of the prior art. Secondarily, the dispenser should provide for replacement of a spent cosmetic such as lipstick, which promotes ecological preservation.

SUMMARY OF THE INVENTION

A primary aspect of the present invention is directed to a powered cosmetic dispenser which addresses the problems described herein with prior art cosmetic dispensers, such as lipstick or the like. More particularly, the powered dispenser described in greater detail below provides a self-contained powered dispenser with a retractable lipstick and which may be electro-mechanically controlled so that it can be manipulated easily with one hand by a user. Even more particularly, the dispenser should be ecologically friendly to provide for reuse after the initial cosmetic unit is spent.

In one embodiment, the powered dispenser for cosmetic sticks includes a case which supports a lipstick cup, or receptacle that is dimensioned for holding one end of a cosmetic stick. A powered control mechanism, such as an electro-mechanical control assembly, is provided in the case for moving the cup up and down within the length of the case so that a cosmetic stick may be selectively moved between an outwardly extended position, wherein the cosmetic may be applied by the user, and a retracted position within the case.

The cosmetic and/or the cosmetic cup may be constructed for removable replacement within the case. More particularly, the cup further comprises outwardly projecting opposed pins.

The case further holds a number of mechanically interconnected tubes. These include an outer tube having opposed L-shaped slots formed along its length. A cap tube is dimensioned for insertion within the outer tube, the cap tube having opposed longitudinal slots formed along its length. Lastly, a spiral tube is dimensioned for insertion within the cap tube, the spiral tube having a spiral slot formed along its length. When assembled, the outwardly projecting pins of the cup extend through the spiral slot of the spiral tube, the opposed longitudinal slots of the cap tube, and into the opposed L-shaped slots of the outer tube, wherein the cup and the interconnected tubes cooperatively move responsive to actuation of the control mechanism.

In an embodiment, the electro-mechanical control mechanism includes a DC-powered motor, a gearhead that is interconnected to the motor, and a DC power supply. While there are numerous possible mechanical interconnections, in this embodiment the gearhead is mechanically interconnected to the spiral tube. The electro-mechanical control mechanism may further include an electronic controller having a printed circuit board containing a microprocessor and a microcontroller. In a further aspect of the invention, and as will be described in greater detail below, the microcontroller may be programmed for a touch interface, a locking actuation, and/or a power conservation mode.

The embodiments described above are exemplary only, and other aspects of the present invention will become apparent to those skilled in the art after a reading of the following description of the preferred embodiment in combination with the figures.

DESCRIPTION OF THE PREFERRED EMBODIMENT

Certain exemplary embodiments of the present invention are described below and illustrated in the attached Figures. The embodiments described are only for purposes of illustrating the present invention and should not be interpreted as limiting the scope of the invention, which, of course, is limited only by the claims below. Other embodiments of the invention, and certain modifications and improvements of the described embodiments, will occur to those skilled in the art, and all such alternate embodiments, modifications and improvements are within the scope of the present invention.

DEFINITIONS

"Powered," as used herein, refers to having, using, or being moved by means of power of a specified kind.

"Cosmetic," as used herein refers to a powder, lotion, lipstick, rouge, or other preparation for beautifying the face, skin, hair, nails, etc.

"Dispenser," as used herein refers to a container, package, or other device that allows the contents to be removed and used in convenient or prescribed amounts.

Figure 1:
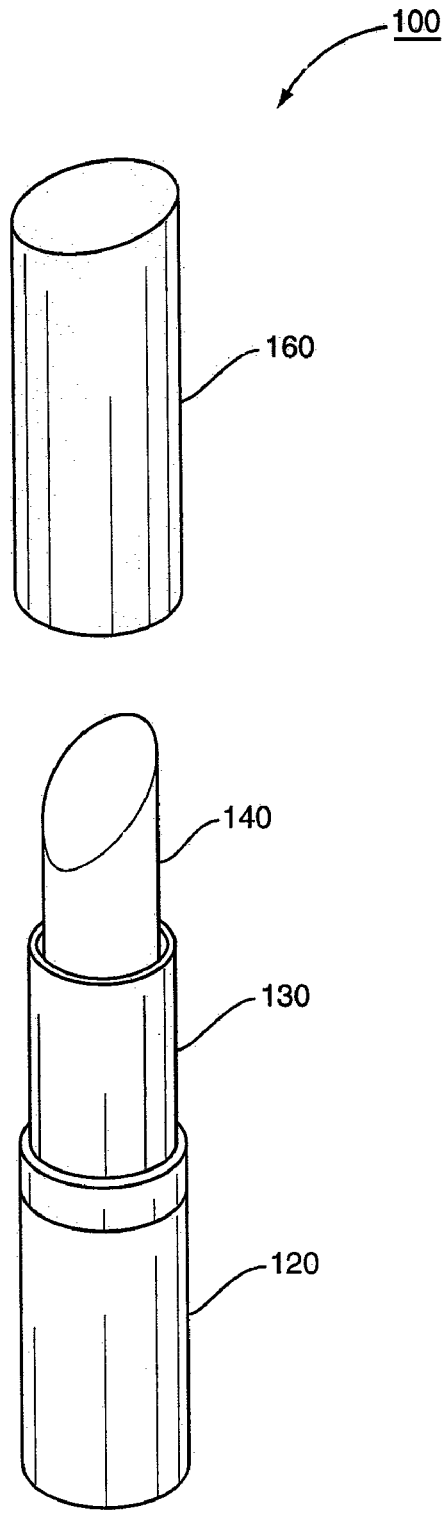
FIG. 1 PRIOR ART
FIG. 1 (Prior Art) is a perspective view of a prior art conventional, manually-operated rotary lipstick dispenser.
Figure 2:
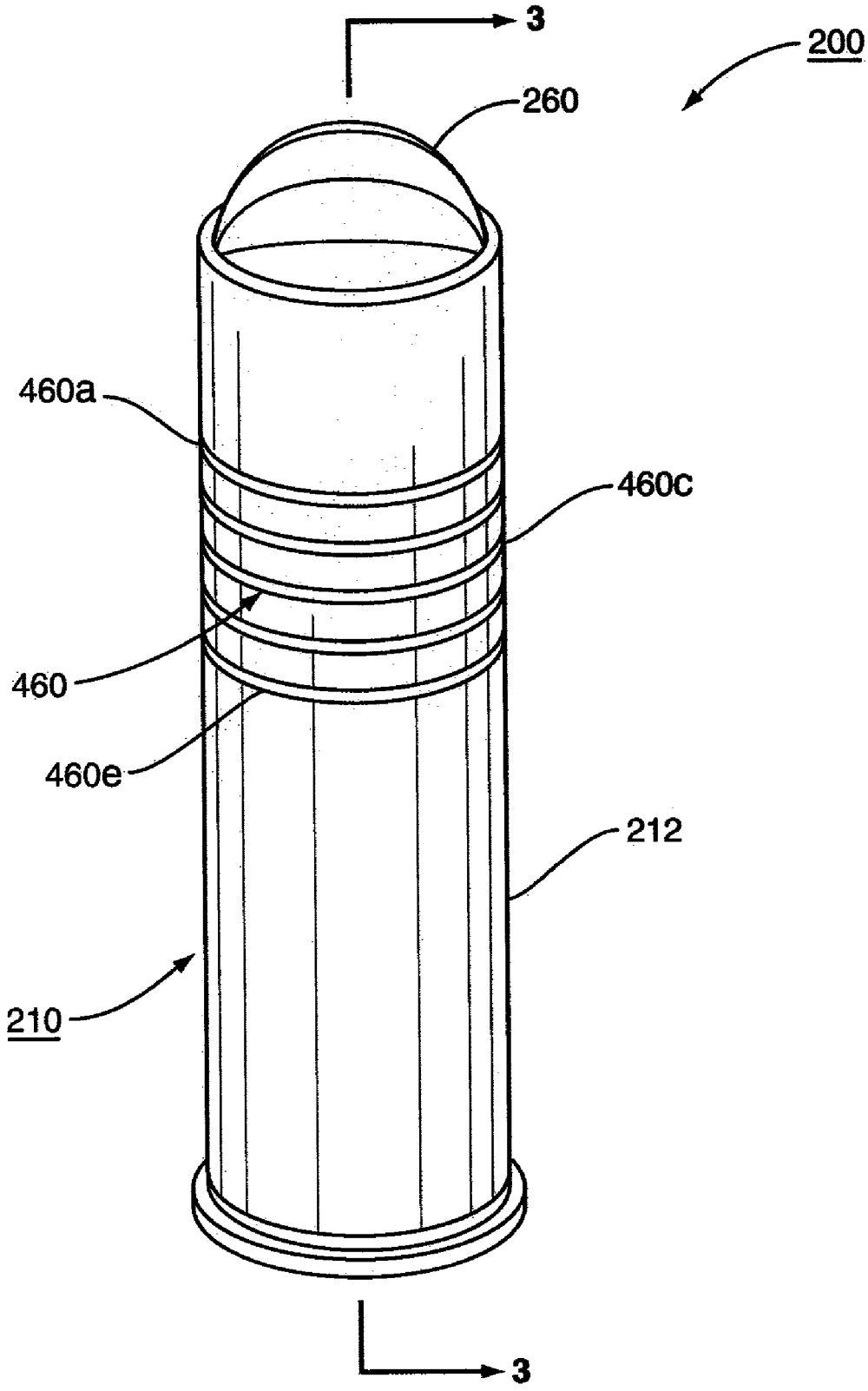
FIG. 2 is a top perspective view of the powered cosmetic dispenser of the present invention.
Figure 3:
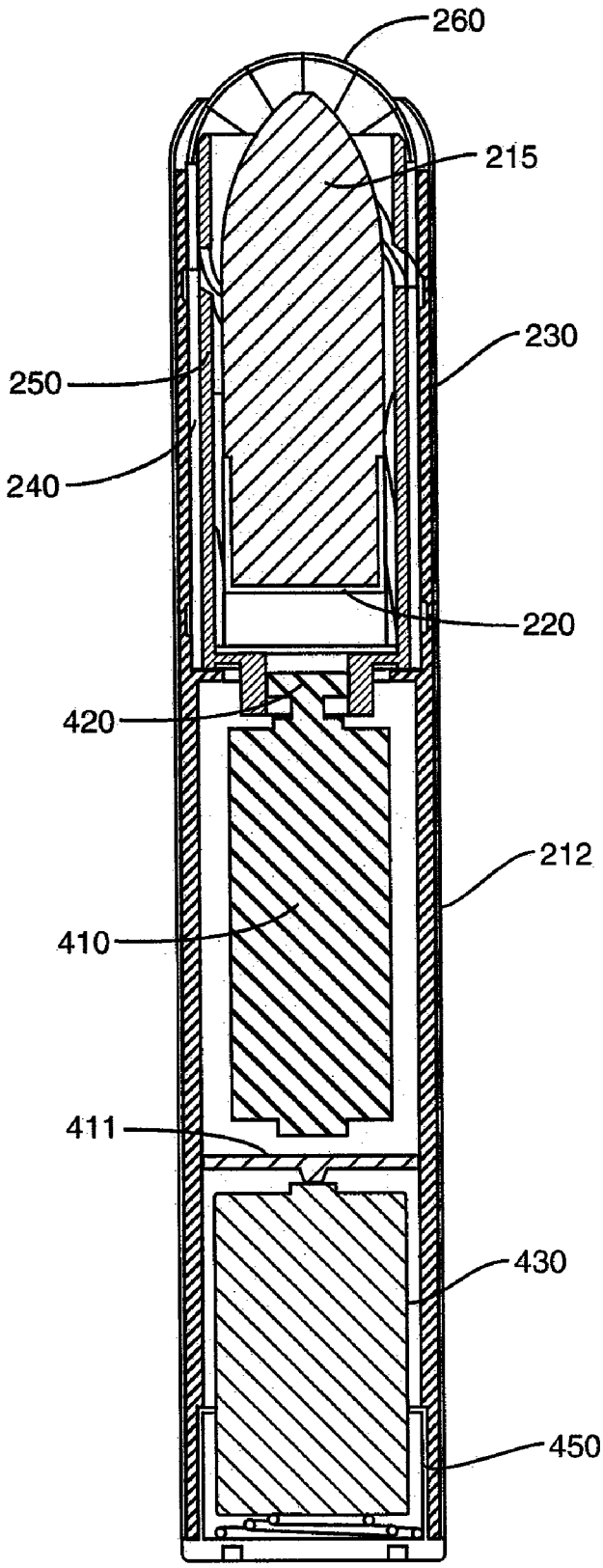
FIG. 3 is a cross-sectional view of the powered cosmetic dispenser of FIG. 2 along Line 3-3.
Figure 4:
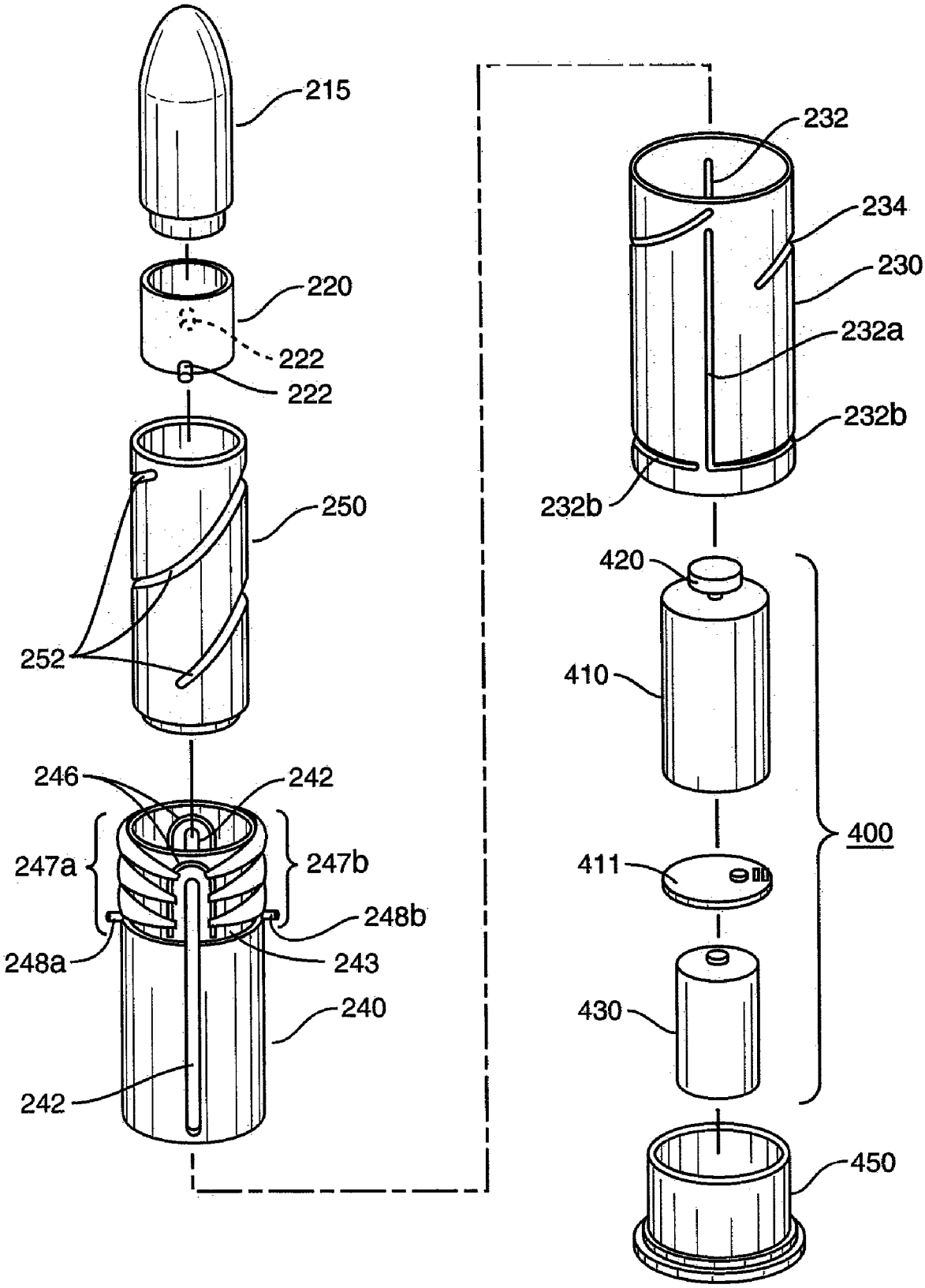
FIG. 4 is an exploded view of the powered cosmetic dispenser of the present invention.

Referring now to the Figures in general, and FIGS. 2-4 in particular, an illustrative embodiment of the present invention is shown as an electro-mechanically controlled cosmetic stick dispenser, shown generally as 200.

In this embodiment, the powered cosmetic dispenser comprises a case 210, and a cosmetic cup or holder 220 that is dimensioned for holding one end of a cosmetic stick 215. An electro-mechanically control mechanism 400 is provided for moving the cup 220 vertically between a completely outwardly extended dispensing position, a retracted or storage position, or selected points therebetween. As described herein, each of both of the cup 220 and the cosmetic stick 215 are removable, and thus replaceable. This means that customers may only need to purchase the dispenser 200 once, and thereafter purchase only replacement cosmetic sticks or pomades 215 or the like, and replacement batteries as needed. As will become more apparent from the description below, this also gives users the choice of selecting different cosmetic stick colors or types for use in the dispenser as occasions or tastes change. The DC battery 430 may be rechargeable, thus eliminating the need for replacement. In this fashion, the powered cosmetic dispenser of the present invention represents an ecologically-sound consumer product.

Turning to FIG. 4, an exploded view of the construction and assembly of the present invention is illustrated. The case 210 of the dispenser 200 may comprise an outer shell 212 (shown in FIG. 2) which houses the constituent parts of the dispenser 200. In addition to the cup 220, the case 210 houses a plurality of interconnected, nested coaxial tubes 230, 240, 250, and the electro-mechanical control mechanism 400. By "nested" is meant that each of the plurality of tubes has a different diameter wherein the tube(s) with a smaller diameter may be received by a tube having a larger diameter. As shown in the Figures, in this embodiment the three tubes 230, 240, and 250 are substantially the same height; however, those skilled in the mechanical arts will appreciate that there are other equally sufficient ways to dimension the tubes and the attributes of each tube, e.g., the slots in the embodiment described herein. With respect to materials, at least the outer shell 212, tubes 230, 240, and 250, and cup 220 may be constructed/molded economically of durable plastic or lightweight metallic materials.

Beginning with the innermost component of the construction, the innermost tube is the spiral tube 250. The spiral tube has a pair of spiral or helical slots 252 formed through the wall of the tube 250 and extending along a substantial portion of the height of the tube 250. These spiral slots 252 are configured for rotational, and therefore vertical movement of the pomade cup 220. As best shown in FIG. 4, opposed pins 222 project outwardly from the wall of the cup 220. Thus, when assembled, the pins 222 are dimensioned to extend through the spiral slots 252 on opposite sides of the spiral tube 250 (and through the slots in the other tubes as described below). As shown in the figure, the spiral tube 250 is dimensioned for insertion within the intermediate, or cap, tube 240.

The cap tube 240 comprises a pair of slots 242 that are formed through opposing sides of the wall of the cap tube 240, extending longitudinally along a substantial length of the tube 240. When assembled, the cap tube 240 receives the smaller diameter spiral tube 250 so that the opposed pins 222 of the cup 220 also extend through the opposed slots 242 of the cap tube 240. Thus, when assembled, the cap tube 240 and the spiral tube 250 may rotate in place; i.e., they do not move vertically as the cup 220 only moves vertically upwardly or downwardly. As will be more fully appreciated from the description that follows, the cup 220 has two distinct motions during operation of the dispenser 200: (1) a rotation without vertical movement, and (2) vertical movement without rotation.

In one embodiment, the cap tube 240 further comprises an upper portion 243, having a diameter slightly smaller than the diameter of the remaining cap tube 240 that is adapted for engagement with a lid 260. As shown in FIG. 4, inverted U-shaped slots 246 are formed in the wall of opposite sides of the upper portion 243 of the cap tube 240 for engagement with a lid assembly 260. The lid assembly 260 comprises two groups 247*a*, 247*b* of interconnected lid segments, the lid segments in each group being mechanically linked together. As shown in FIG. 4, each group 247*a*, 247*b* is connected to one side of each inverted U-shaped slot 246, thereby causing the two groups of segments to meet over the center of the cap tube 240 when the lid 260 is in a closed position. Forming and arranging the lid segments in this manner reduces the vertical movement necessary for the groups 247 to reach the fully open, or fully closed, position. The lid segments may be semi-cylindrical in cross-section so that when retracted, the groups 247 of lid segments will fit snugly against the outer wall of the upper portion 243 of the cap tube 240. Configured in this manner, the cosmetic stick 215 is permitted to pass freely without interference from the lid 260. As will be appreciated, it is also possible to construct the lid segments in each group 247 as more spherically-shaped pieces to maintain an even tighter closing lid construction. For simultaneous movement of the groups 247 between open and closed positions, a pin 248 that is affixed to the lowermost piece of each of the two groups 247 is interconnected to the outermost tube 230, as described below. Thus, any rotation of the cap tube 240 will cause the lid segment groups 247 to slide in their respective tracks 246 to open or close, depending upon the direction of rotation.

The outer tube 230 is dimensioned to receive the small diameter cap tube 240. The outer tube 230 has a pair of opposed L-shaped slots 232 formed through opposite sides of the tube wall and along its length of the tube 230. As shown in the Figure, the longer portion 232*a* of the L-shaped slot 232 extends along the length of the outer tube, and the shorter portion 232*b* of the slot 232 extends from the lower end of the longer portion 232*a* at substantially a right angle. When assembled, the outer tube 230 receives the smaller diameter cap tube 240 so that the opposed pins 222 of the cup 220 also extend through the opposed L-shaped slots 232 of the tube 240. Once assembled, the three tubes 230, 240, 250 are ready for insertion within the outer shell 212. Also formed through the outer tube 230 is a spiral slot 234 which receives the opposed pins 248 for the lid segment groups 247 so that the two groups 247*a*, 247 *b* will close or retract upon rotation of the cap tube 240.

From a closed position, opening of the lid 260 commences with a clockwise (when viewed from the top or dispensing end of the dispenser) rotation of the cap tube 240. This causes the pins 248 of the lid segment groups 247 to follow the spiral track 234 of the outer tube 230 such that the lid segment groups 247*a*, 247*b* retract to a lower, stored position. Thus, this opens the dispenser lid 260 and readies the dispenser 200 for extension of the lipstick or other cosmetic product 215.

The outer tube 230 may be fixed to the inner wall surface outer shell 212 of the dispenser 200. The opposed pins 222 are of sufficient length to be engaged within the opposed L-shaped slots 232, yet are not so long that they impinge upon the outer tube 230, thus permitting free movement of the pins 222. Alternatively, the outer shell 212 and the outer tube 230 may be formed as a singular piece.

Turning again to FIG. 4, the electro-mechanical control mechanism 400 of the dispenser 200 is shown. In the embodiment shown, the electro-mechanical control mechanism 400 comprises a DC-powered motor 410, a gearhead 420 for speed reduction that is mechanically interconnected to the motor 410, and a DC power supply, such as a battery 430. The motor 410 and microprocessor (described below) derive power from the battery 430. The motor 410 output is connected to the gearhead 420, which may be integral to the motor 410, or which may be designed as a separate assembly. In one embodiment, the gearhead 420 is a 3 or 4-stage device, having a gear turning ratio of between about 120:1 and 300:1. The gear ratio is chosen based on the nominal loaded speed of the motor 410, the desired output speed, and the torque required to rotate the spiral tube 250 an interconnected components. It is customary in the art to design the motion system so that the motor operates near its peak efficiency, and to minimize the likelihood of a stalled condition. The motor 410 and gearhead 420 rotation is mechanically coupled to the spiral tube 250, wherein the two are connected rigidly as in a press fit, or with a square or splined output shaft of the gearhead 420 that engages a mating portion of the spiral tube 250. A battery access cap 450 is provided to close the lower end of the case 212. In the embodiment shown, the battery access cap is dimensioned to screw into the outer tube 230; however, the cap 450 alternatively could be formed to screw into the outer shell 212, or could be dimensioned to frictionally engage the outer tube 230 or the outer shell 212.

Figure 5:
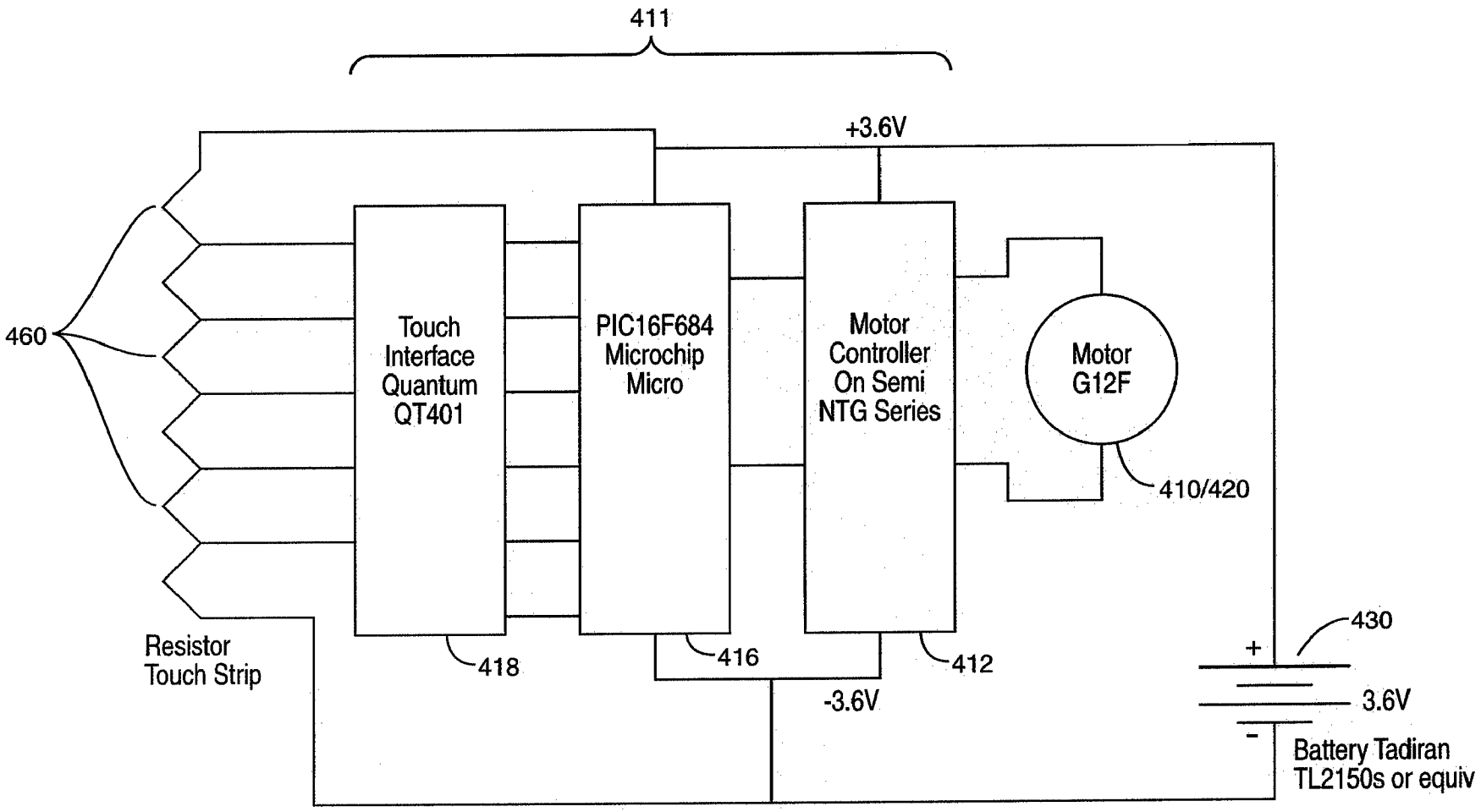
FIG. 5 is a schematic representation of the electro-mechanical control mechanism of the powered cosmetic dispenser of the present invention.

Referring now to FIG. 5, an electrical schematic of the electro-mechanical control mechanism 400 is shown. The electrical circuit of the electro-mechanical control mechanism 400 may be powered by a replaceable/rechargeable power source comprising primary or secondary cells (batteries), high capacitance capacitors, or other fuel cells suitable for powering a DC motoring running in DC, AC, and/or Pulse Modulation modes. One suitable battery is the Model TL2150S available from Tadiran of Israel, which is a 3.6v 1Ah lithium battery.

In the embodiment shown in FIG. 3, the motor 410 is a Model G12F available from Shenzhen Flying Motor Industrial Company of China. This particular motor assembly includes the DC motor 410 and an integrated gearhead 420 with a 298:1 reduction. The choice of having an integral motor/gearhead assembly or two separate assemblies is appreciated in the art by designers of ordinary skill. This reduction decreases the output speed and increases the torque capability of the motor. This embodiment may also include a motor controller integrated circuit 412 (see FIG. 5), available for example from the NTG series supplied by On Semiconductor of Arizona. Motor controllers enable the speed of the motor to be variably adjusted. Use of the motor controller in the present invention is described below. Those skilled in the art will appreciate that the means of activation is not limited to the use of a motor/gearhead. Several alternatives are now known in the art including shape memory alloys that may be implemented as micro-actuators, solenoids, piezoelectric actuators, etc.

Additional aspects of the present invention are enabled through the placement of a microprocessor/microcontroller 416 is series with the motor 410 and the motor controller 412. As used herein, the terms "microprocessor" and "microcontroller" may be used interchangeably. The microprocessor/controller 416 is central to the operation of the dispenser 200. One suitable microprocessor is a PIC 16F684 processor, available from Microchip of Arizona. This processor, and other suitable equivalent processors, provides Input/Output, programmability, memory, and other features that are needed for proper operation of the dispenser 200. All electronic components such as the integrated circuits and other discrete electronic components are assembled to a printed circuit board or other suitable substrate, the assembly shown generally as 411 in the Figures.

One aspect of the microcontroller 416 is that it may be placed in a "sleep mode" to conserve battery 430 power. Wake up would occur when activity is sensed by one or more of the touch sensors 460.

Another aspect of the dispenser 200 provides for actuation and locking of the dispenser 200. In one embodiment, an algorithm, referred to herein as the Function in Progress Algorithm, provides security for the dispenser 200 to keep unwanted users such as children from accessing the lipstick, and prevents accidental operation of the dispenser 200 while stored in a purse, pocket, etc. Activation, or the unlocking of the device, would be by means of one or more sensory zones, i.e., touch sensors 460 for input to the microprocessor 416 via an interface controller 418. An example of a suitable interface controller 418 is a Field Programmable Gate Array (FPGA), Complex Programmable Logic Device (CPLD), or logic interface integrated circuit (IC), as these devices are known in the art and generally commercially available. In one embodiment, the device is a Touch Interface IC, Model QT401 from Quantum Research Group in England. Those in the art will appreciate that input devices that could communicate with such a controller include resistive or capacitive touch surfaces, switches (push, pull, toggle), jog dials, optical encoders, voice prompts, etc.

The Function in Progress Algorithm is a program that requires certain inputs from the user over a specified period of time in order to activate, or unlock the device. If a specified input does not occur within the specified period of time, the software resets and requires the user to start over with the inputs. The specified required inputs can be of variable length which can be programmed by the user. The period of time between inputs from the user can be programmed for user convenience. Additionally, multiple inputs, i.e., sensory zones 460, can be utilized in the algorithm where a particular sequence is required. The preset pattern (both timing and input sequence) is coded into the firmware, and upon initial power up this pattern is required to actuate the device.

The dispenser 200 is activated by a sequence of events in one or more of the touch sensor 460 zones described above. As shown in FIG. 2, the touch sensors 460 comprise a series of resistive touch strips in the circuit. Activation is based on the different touch sensors 460 being touched in a combination pattern. For example, to activate the dispenser 200 described herein having five touch sensors 460, a sequence such as top 460*a*, bottom 460*e*, middle 460*c*, top 460*a*, and bottom 460*e* may be needed to activate the dispenser. The dispenser 200 may also be deactivated (locked) by a similar touch sequence, or by a built-in timeout. Another means of activation may be by means of one touch sensor 460 that is touched in a timed sequence, such as a series of short and long contacts, similar to Morse Code.

For the embodiments described above, it is also possible to program the microprocessor/microcontroller 418 for additional features. For example, the microprocessor 418 may be programmed to allow a user to change the activation/lock codes, or eliminate the lock code altogether. Users may also set the device 200 based on individual preferences such as faster or slower operating speeds.

Sensors may also be incorporated into the circuitry embodiments shown for determining the position of the cosmetic stick 215 in order to reduce the extension time of the stick 215 and to extend the battery 430 life. A sensor such as a gyro could also be used to determine the orientation of the dispenser to prevent accidental operation or to activate/deactivate the device, e.g., 'wave the wand.' Such gyros are now embedded within IC chips.

Figure 6:
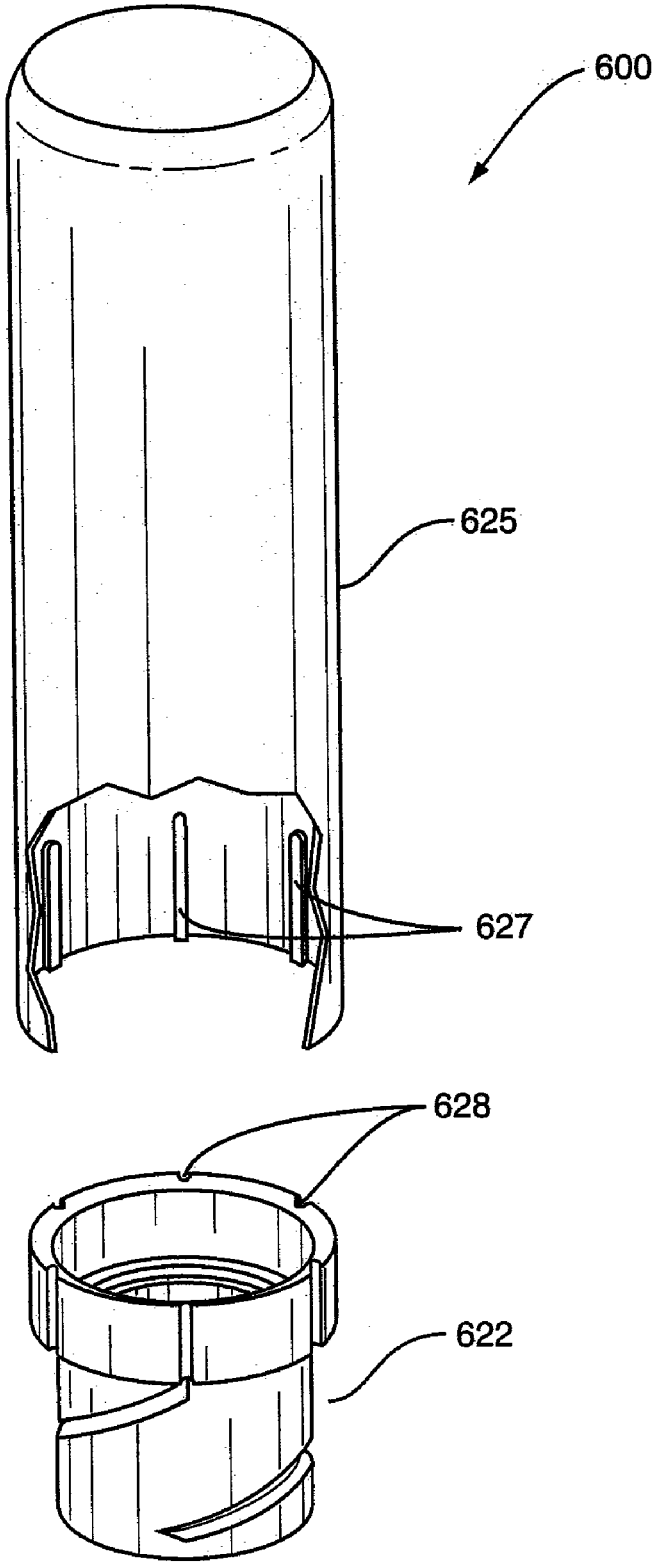
FIG. 6 is an exploded view of a further aspect of the powered cosmetic dispenser of the present invention illustrating the replaceable cosmetic stick.

A further aspect of the powered cosmetic dispenser 200 is directed to a dispenser 200 having a removable/replaceable cup and/or cosmetic stick combination that furthers the ecologically sound aspects of the invention. As shown in FIG. 6, the replaceable cartridge 600 comprises a screw-in cup 622, a protective cover 625, and a cosmetic stick (not shown). The protective cover 625 comprises a series of locking ridges 627 that interlock with corresponding grooves 628 in the removable cup 622 that allow a user to screw the removable cup 622 into place in the dispenser 200 with only a one-quarter or one-half turn and then pull the cover off. The removable cup 622 comprises screw threads (not shown) or the like that would engage corresponding threads (not shown) in the mating cup 220, the cup 220 being appropriately modified to receive the removable cup 622. Thus, in operation a user would open the lid 260 as described above, insert the removable cartridge 600 into the open top of the dispenser 200, screw the removable cup 622 into position, and pull the removable protective cover 625. The protective cover 625, which has a diameter smaller than the internal diameter of the open dispenser 200 is guided by the internal diameter of the dispenser 200 to minimize damage to the cosmetic stick while extracting the cover.

Figure 7:
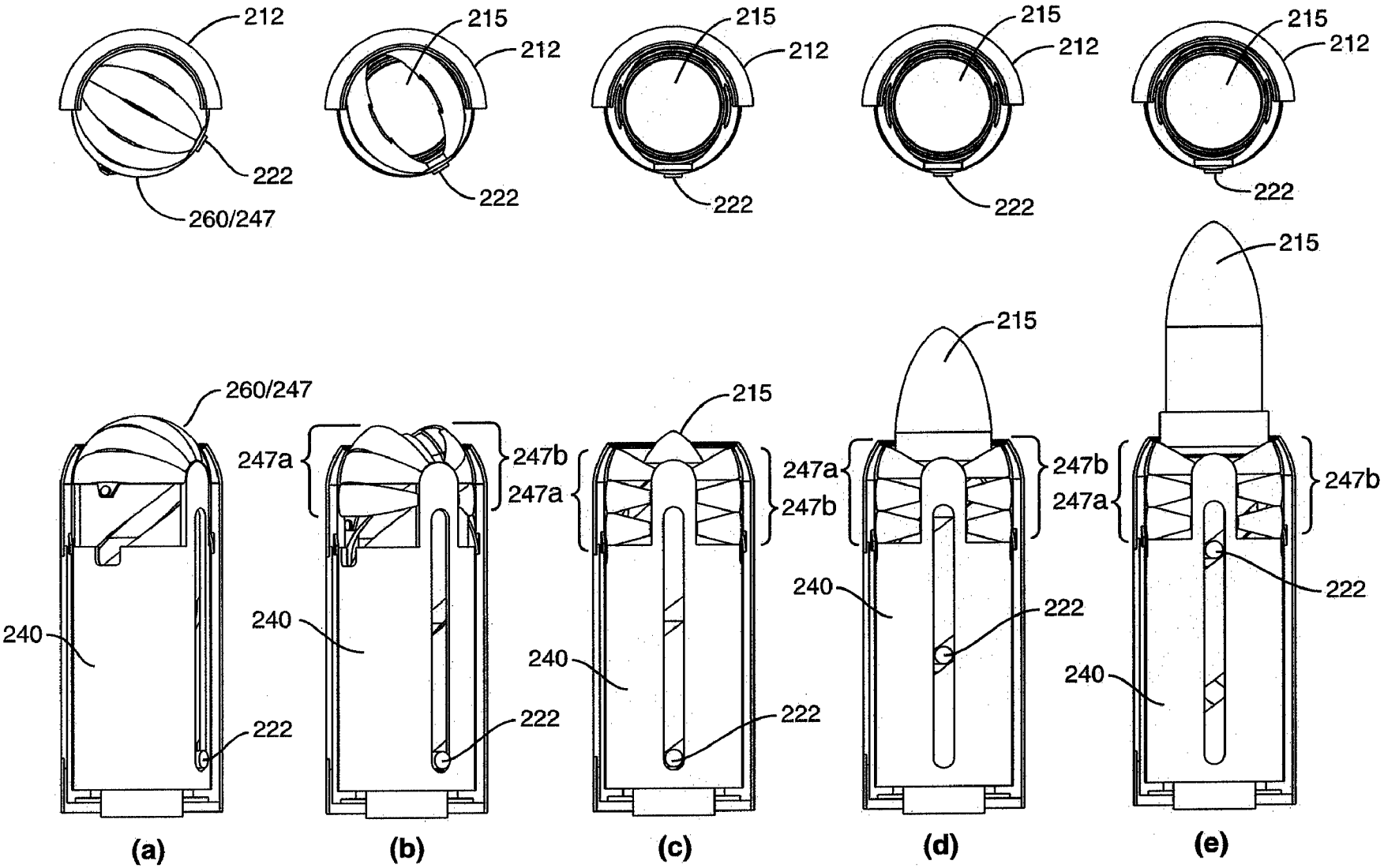
FIGS. 7A through 7E are side cut-away views of the upper portion of the dispenser illustrating the relative movement of the components at several exemplary positions.

In operation, the dispenser 200 is activated via one or more of the touch sensors 460, as described above. As the finger is moved from zone (touch sensor) to another, this is sensed by the microprocessor 416 via the interface controller 418. Sliding the finger in one direction, for example, opens the lid 260 and extends the cosmetic stick 215, while sliding the finger in the opposite direction may retract the cosmetic stick 215 and close the lid 260. The microprocessor 416 then activates and determines which direction (upward or downward) the motor 410 should turn by sending the appropriate signals to the motor controller 412. Adjusting the speed at which the finger is moved across the touch sensors 460 can vary the speed of the motor 410. The electronic controller 412 then controls the motor 410 having its output connected to the gearhead 420. As shown in FIGS. 7A through 7E, the operation of the dispenser is illustrated in stages. Referring first to FIG. 7A, the dispenser 200 is initially in a closed state with the lipstick 215 fully retracted. Since the motor 410 and gearhead 420 rotation is coupled to the spiral tube 250, the spiral tube 250 rotates, causing the opposed cup pins 222 to slide in the shorter, horizontal section 232*b* of the L-shaped slot 232 in the outer tube 230, as shown in FIG. 7B. As shown in FIG. 7C, as the rotation continues, this results in approximately a one-fourth to one-third turn of the spiral tube 250, cup 220, cap tube 240, and associated movement of the lid segment groups 247. This partial rotation is sufficient to retract the lid segment groups 247 so that the end of the cap tube 240, and hence the lid 260 is completely open. At this point, the cup pins 222 intersect the corner of the L in the L-shaped slot 232 of the outer tube 230. This provides a transition wherein upward vertical movement of the cup 220 commences, rotation of the cap tube 240 ceases, and the lip segment groups 247 retract no further. The upwardly vertical motion then continues until the user stops the device 200 via the touch sensors 460 and proceeds to apply the lipstick, as in FIG. 7D, or until the cup 220 reaches its mechanical upper limit, as shown in FIG. 7E. This sequence, as illustrated in FIGS. 7A-7E, shows a new lipstick 215 or other cosmetic pomade, but as will be appreciated there will be a need for further extension of the lipstick 215 as it is consumed over several uses. Retraction of the cup 220 and lid 260 occurs in exactly the opposite order as described above. The dispenser 200 is subsequently deactivated by the electronic controller 416 to prevent accidental operation while stored in the purse, a pocket, or the like by means of the Function in Progress protocol described above. This protocol is initiated only upon opening the dispenser 200.

It will be understood by those skilled in the art that while the foregoing has been described with reference to preferred embodiments and features, various modifications, variations, changes and additions can be made thereto without departing from the spirit and scope of the invention. For example, the replaceable cup, the outer shell with retractable lid, and the particular control mechanism described are preferable versions, but one or all of these features may be eliminated in a simpler version that still adopts the essence of the invention, which is the powered movement of the cosmetic stick.

We claim:

1. A powered dispenser for cosmetic sticks, comprising:

(a) a case having a length and an open end;

(b) a cup operatively disposed within the case and dimensioned for holding a cosmetic stick; and (c) an electro-mechanical control mechanism within the case and connected to the cup for selectively moving the cup up and down within the length of the case, the electro-mechanical control mechanism comprising:

(i) a DC-powered motor;

(ii) a gearhead interconnected to the motor; and (iii) a DC power supply;

wherein a cosmetic stick is movable between an extended position outwardly of the open end of the case and a retracted position within the case.

2. The powered dispenser of claim 1 further comprising a cosmetic stick.

3. The powered dispenser of claim 2 wherein the cosmetic stick is removably replaceable in the cup.

4. The powered dispenser of claim 1 wherein the case comprises a plurality of mechanically interconnected coaxial tubes contained within an outer shell.

5. The powered dispenser of claim 4 wherein the cup further comprises outwardly projecting opposed pins and wherein the plurality of mechanically interconnected tubes comprises:

(a) an outer tube, the outer tube having a Length and opposed L-shaped slots formed along its length;

(b) a cap tube dimensioned for insertion within the outer tube, the cap tube having a length and opposed longitudinal slots formed along its length;

(c) a spiral tube dimensioned for insertion within the cap tube, the spiral tube having a length and a spiral slot formed along its length; and (d) the outwardly projecting pins of the cup extending through the spiral slot of the spiral tube, the opposed longitudinal slots of the cap tube, and the opposed L-shaped slots of the outer tube, wherein the cup and the plurality of interconnected tubes cooperatively move responsive to actuation of the control mechanism.

6. The powered dispenser of claim 5 further comprising an outer shell, the outer shell dimensioned for receiving the control mechanism, the plurality of interconnected tubes, and the cup.

7. The powered dispenser of claim 5 wherein the gearhead is mechanically interconnected to one of the spiral tube, cap tube, and outer tube for rotatable movement thereof.

8. The powered dispenser of claim 1 wherein the dispenser further comprises a retractable lid assembly operable responsive to movement of the cup to open and close the lid.

9. The powered dispenser of claim 8 wherein the retractable lid assembly comprises:

(a) at least one group of linked lid segments;

(b) the at least one group of linked lid segments interconnected to one of the outer tube, cap tube, and spiral tube; and (c) wherein the at least one group of lid segments cooperatively moves responsive to actuation of the electro-mechanical control mechanism to a selected open or closed condition.

10. The powered dispenser of claim 1 wherein the electro-mechanical control mechanism further comprises an electronic controller.

11. The powered dispenser of claim 10 wherein the electronic controller comprises a microprocessor which controls at least one of a touch interface, lock actuation, and power conservation actuation.

* * * * *